US006701573B1

(12) United States Patent
Ciavarella et al.

(10) Patent No.: US 6,701,573 B1
(45) Date of Patent: Mar. 9, 2004

(54) FAST ASSEMBLY HINGE

(75) Inventors: Nick E. Ciavarella, Seven Hills, OH (US); David Hayes, Wooster, OH (US)

(73) Assignee: Joseph S. Kanfer, Richfield, OH (US)

( * ) Notice: Subject to any disclaimer, the term of this patent is extended or adjusted under 35 U.S.C. 154(b) by 0 days.

(21) Appl. No.: 10/200,380

(22) Filed: Jul. 23, 2002

(51) Int. Cl.[7] ..... E05D 7/10

(52) U.S. Cl. ..... 16/266; 16/257; 16/262; 16/268; 220/840

(58) Field of Search ..... 16/262, 380, 265, 16/266, 267, 268, 257; 220/836, 840, 841

(56) References Cited

U.S. PATENT DOCUMENTS 2,677,479 A * 5/1954 Yoneo ..... 220/840
3,295,713 A * 1/1967 Optner ..... 220/840
4,515,424 A * 5/1985 Sakurai ..... 439/325
4,729,134 A * 3/1988 Hillebrand et al. ..... 4/236
5,127,132 A * 7/1992 Karlin ..... 16/261
5,669,106 A * 9/1997 Daoud ..... 16/266
6,000,550 A * 12/1999 Simpson et al. ..... 206/711
6,461,026 B1 * 10/2002 Wang ..... 362/374

FOREIGN PATENT DOCUMENTS

FR 2735175 A1 * 12/1996

* cited by examiner

*Primary Examiner*—Chuck Y. Mah
(74) *Attorney, Agent, or Firm*—Renner, Kenner, Greive, Bobak, Taylor & Weber

(57) ABSTRACT

A hinge assembly for securing a pivotally movable cover to a back or support plate includes a pair of hinge pins projecting from the back or support plate and a pair of hollow pin receiving barrels projecting from the cover for receipt of the pins. The hollow pin receiving barrels and the pins are provided with complemental ribs and grooves for releasable interengagement when the pins and barrels are interconnected.

2 Claims, 5 Drawing Sheets

FAST ASSEMBLY HINGE

RELATED PATENT APPLICATIONS

None.

FIELD OF THE INVENTION

This invention relates in general to an improved fast assembly hinge for hinging two elements together for movement relatively of each other and relates in particular to such a hinge for supporting the cover of a vertically mounted dispenser having a wall-mounting plate or back plate and a cover movable between open and closed positions.

BACKGROUND OF THE INVENTION

There are a wide number of dispensers for various products known in the art. One particular type of such a dispenser is designed to be mounted on a wall or other vertical surface and includes a back plate or wall-mounting plate and a cover which is hinged at one end to one end of the back plate and intended to be movable between open and closed positions. These dispensers generally will contain, on the back plate, a removable cartridge or refill package of some sort which will contain the material intended to be dispensed from the dispenser.

There are a number of various hinge arrangements known in the art, and in most of the prior art, the cover is hinged to the back plate by snapping the two elements together at the point of hinged connection.

The major disadvantage of this arrangement is that dispensers of this type tend to be found in every industrial and commercial facility and, as such, they sustain a significant range of abuse when they are installed. This can be a serious problem in the field in that the cover or the hinge or both can sustain severe damage even to the extent of making the dispenser unusable.

The problem with the current known designs are that the snap together forces are quite high because the snap is all that holds the hinged components together. For example, when one is routinely replacing a spent container or cartridge with a new, full one the procedure is simply to swing the cover to the open position, remove and discard the old, empty container or cartridge, insert the new full one and close the cover. In performing this function it is common to rest the new, full container or cartridge on the open cover while removing the old one. Thus, a common hinge robustness test would be to place a full refill cartridge or container on the cover to see if that causes the hinge to break or come apart. This test replicates what often happens in the field where the individual refilling the container will rest the refill cartridge on the cover in its open position while removing the spent cartridge and it has been found that the usual known hinge will frequently come apart or even break.

Accordingly, it is felt desirable to provide a hinge assembly which is quite easy to assemble when the dispenser per se is assembled, but yet which is strong enough to resist the major forces that the hinge will typically see in use.

SUMMARY OF THE INVENTION

In accordance with the above-noted object, it has been found that such a fast assembly yet durable hinge assembly can be provided by providing hinge barrels carried by the cover which receive hinge pins carried by the back plate. The hinge pins are designed to snap into the barrels along their longitudinal axes and, in practice, the weight of the forces normally encountered are borne by the hinge pins.

It has further been found that if the hinge barrels and hinge pins can be arranged horizontally, then the length of the hinge pins and the barrels provide support along the axis of the hinging movement as contrasted to the snap together designs of the prior art.

It accordingly becomes a principal object of this invention to provide a fast assembly hinge assembly of the character above-described with other objects thereof becoming more apparent upon a reading of the following brief specification considered and interpreted in view of the accompanying drawings.

BRIEF DESCRIPTION OF THE PREFERRED EMBODIMENTS

Figure 1:
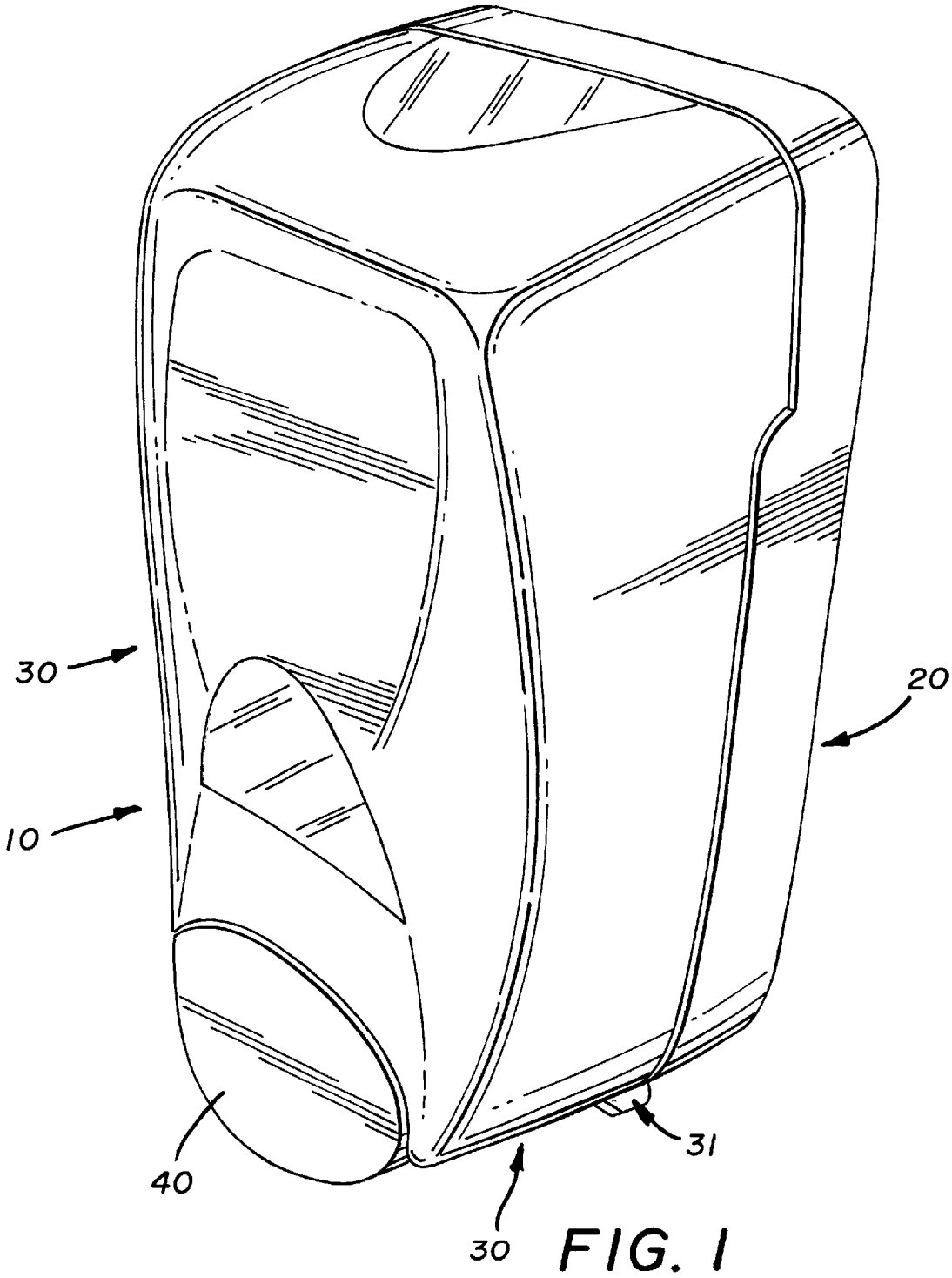
FIG. 1 is a perspective view of one type of dispenser showing the cover in the closed position with respect to the back plate.

Referring first to FIG. 1 of the drawings, it will be seen that one type of dispenser with which the present invention would have utility is illustrated and generally indicated by the numeral 10. This dispenser includes a back plate 20 which is intended to be mounted on a vertical surface and may be installed either permanently or removably.

The cover, generally indicated by the numeral 30, is hinged as at 31 to the back plate for movement between open and closed positions relative to the back plate 20 as will be described in more detail below.

Figure 2:
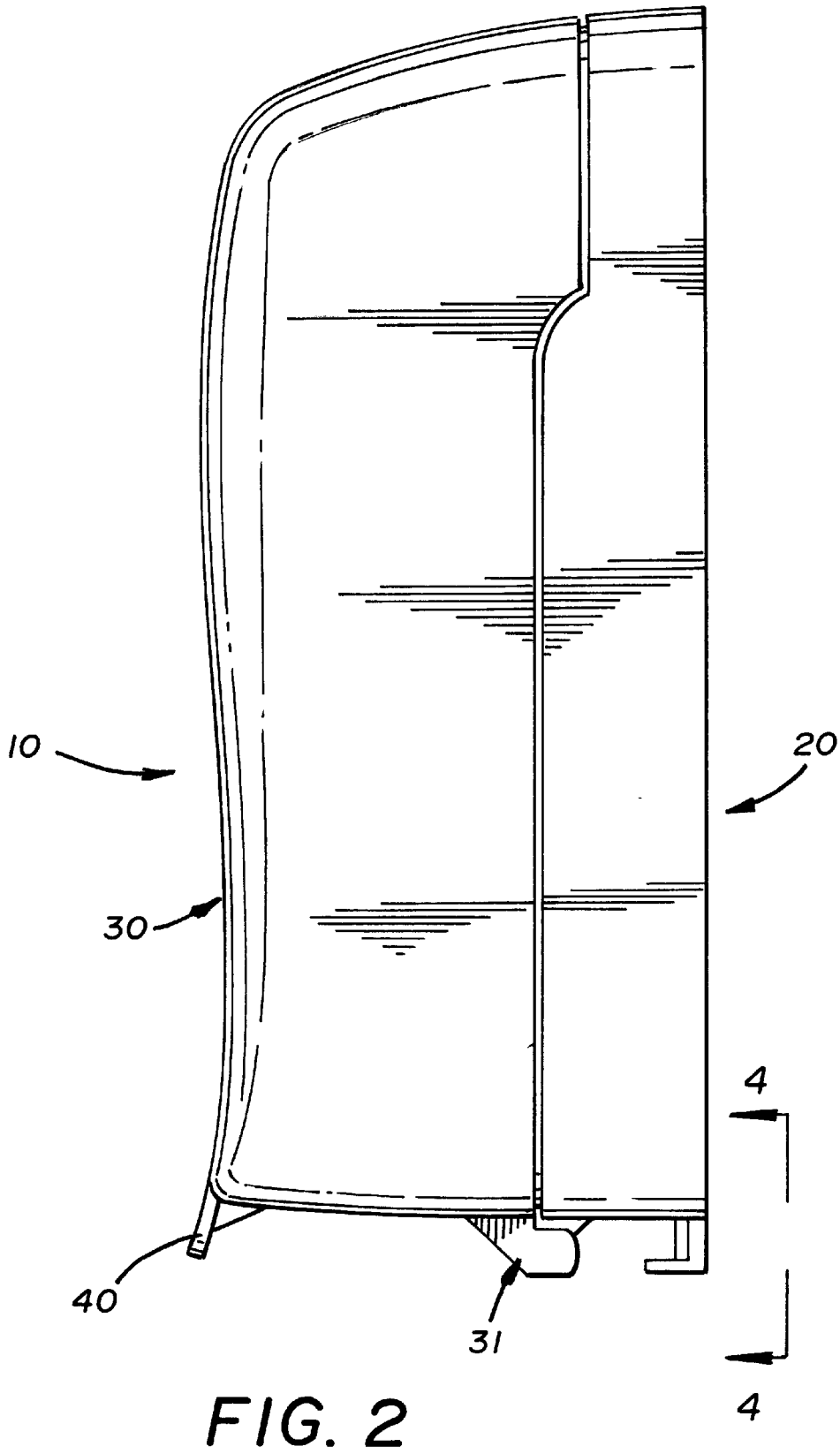
FIG. 2 is side elevational view of the dispenser of FIG. 1.
Figure 3:
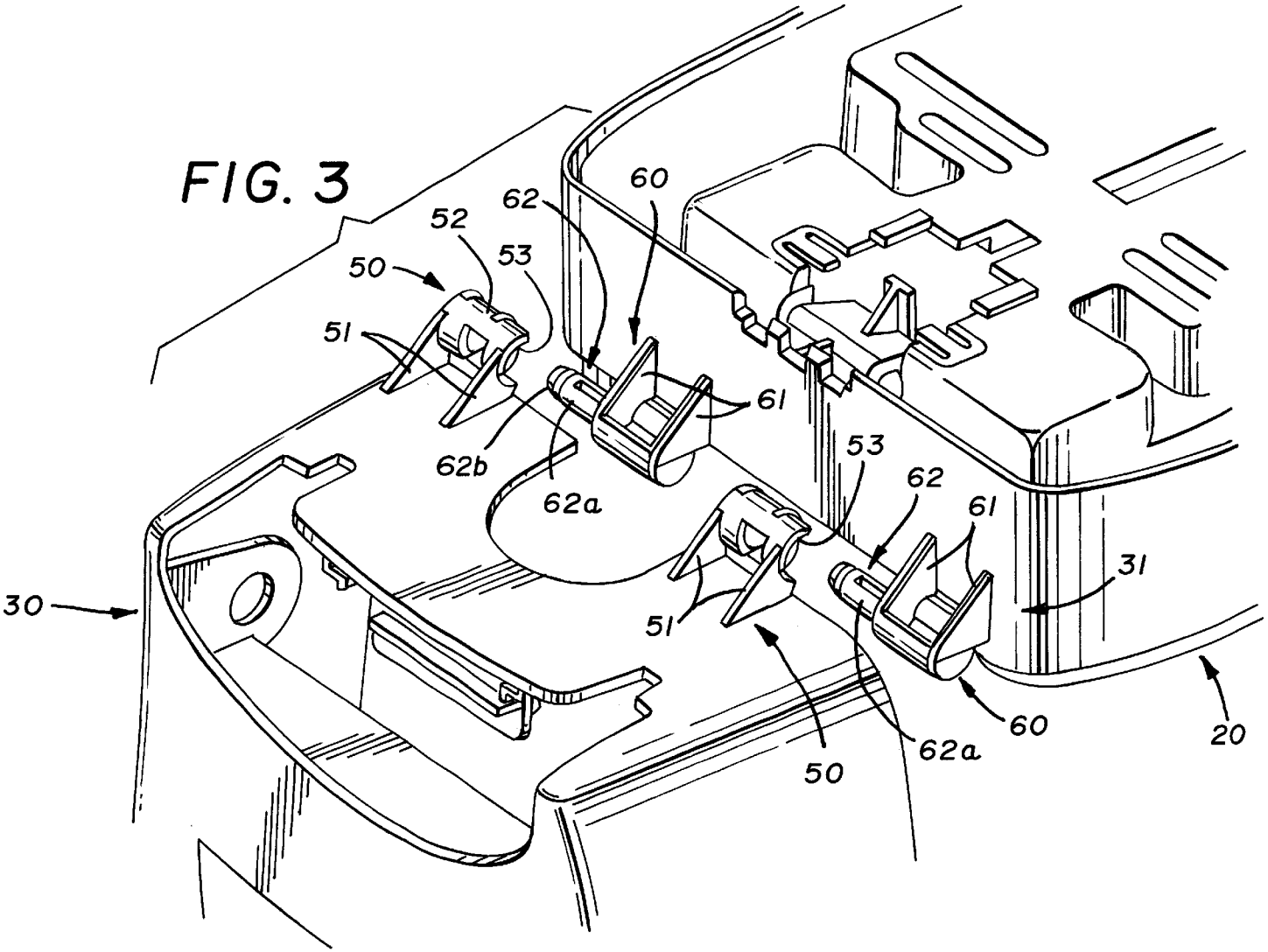
FIG. 3 is an exploded view showing the back plate, cover and hinge assembly in the disassembled condition just prior to assembly.
Figure 4:
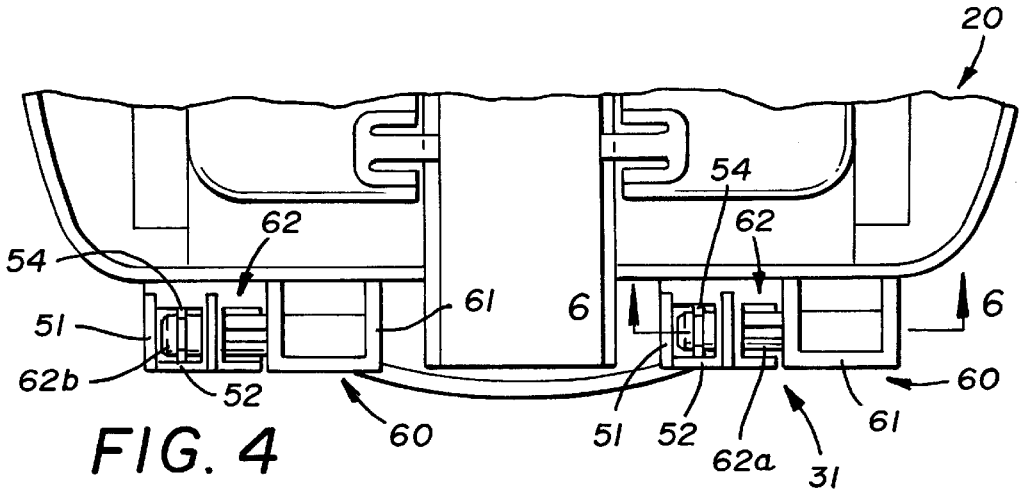
FIG. 4 is a view taken along the line 4—4 of FIG. 2.

Still referring to FIGS. 1 and 2 of the drawings, it will be seen that a push bar or pressure member 40 is also carried by the cover and the operation of dispensers of this type generally involves placing a refill cartridge (not shown) with a pump on it inside the dispenser with the pump and an attached nozzle extending to the bottom of the assembled structure so that actuation of the push bar or pressure member 40 activates the pump and discharges a known quantity of material onto the hand of the user or into a receptacle, as the case may be.

It should be understood that one exemplar of a dispenser of this general nature is illustrated in the drawings and described herein for illustrative purposes, but that the hinge assembly, which is the subject of this invention, would have equal utility with a wide range of dispenser designs so long as a cover and a back plate are provided and it is intended that the cover be openable by pivoting about its point of connection with the back plate or support member.

Turning then to FIGS. 3 through 8 for a description of the hinge assembly of the current invention, it will be seen that attached to the cover and projecting therefrom are a pair of hinge "barrels" 50. These barrels are mounted, in the form of the invention illustrated, by support brackets 51, 51 which project from one end of the cover 30 and are generally circular in configuration, although a complete circle is not necessary. That is, the body 52 of each barrel has at least a partial circular circumference and has at least one open end 53 for receipt of the appropriate hinge pin as will be described.

Figure 5:
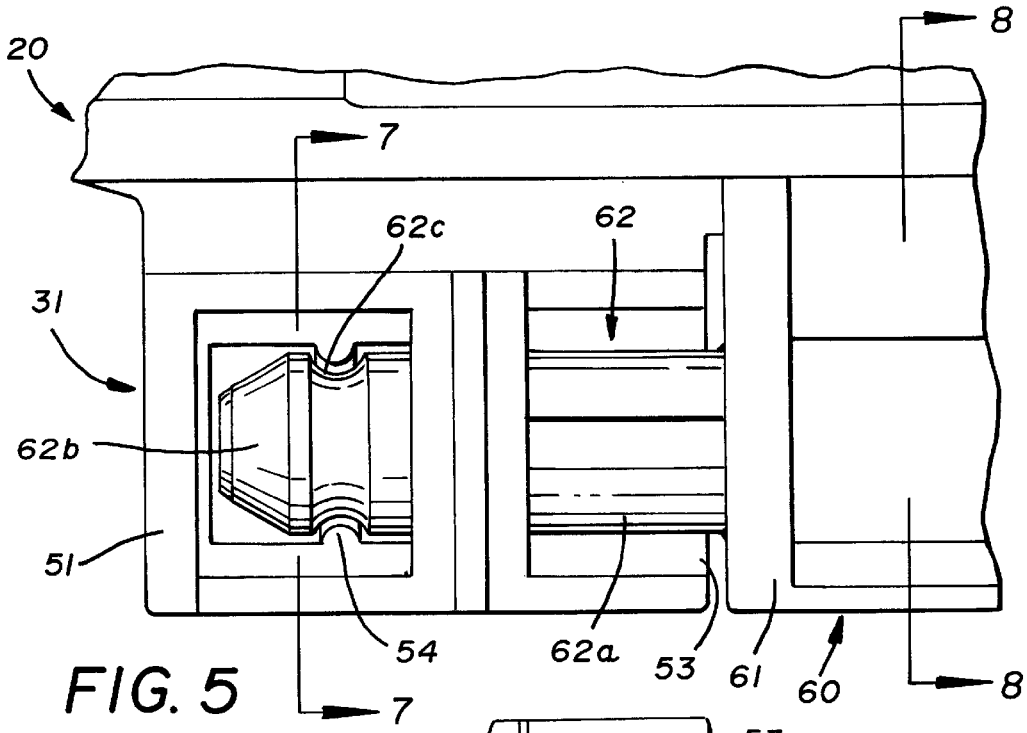
FIG. 5 is an enlarged elevational view showing the one part of the hinge assembly in the assembled condition.
Figure 7:
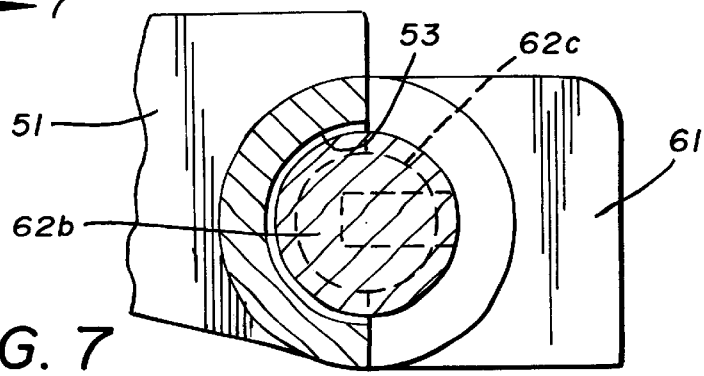
FIG. 7 is a sectional view taken along the line 7—7 of FIG. 5.
Figure 6:
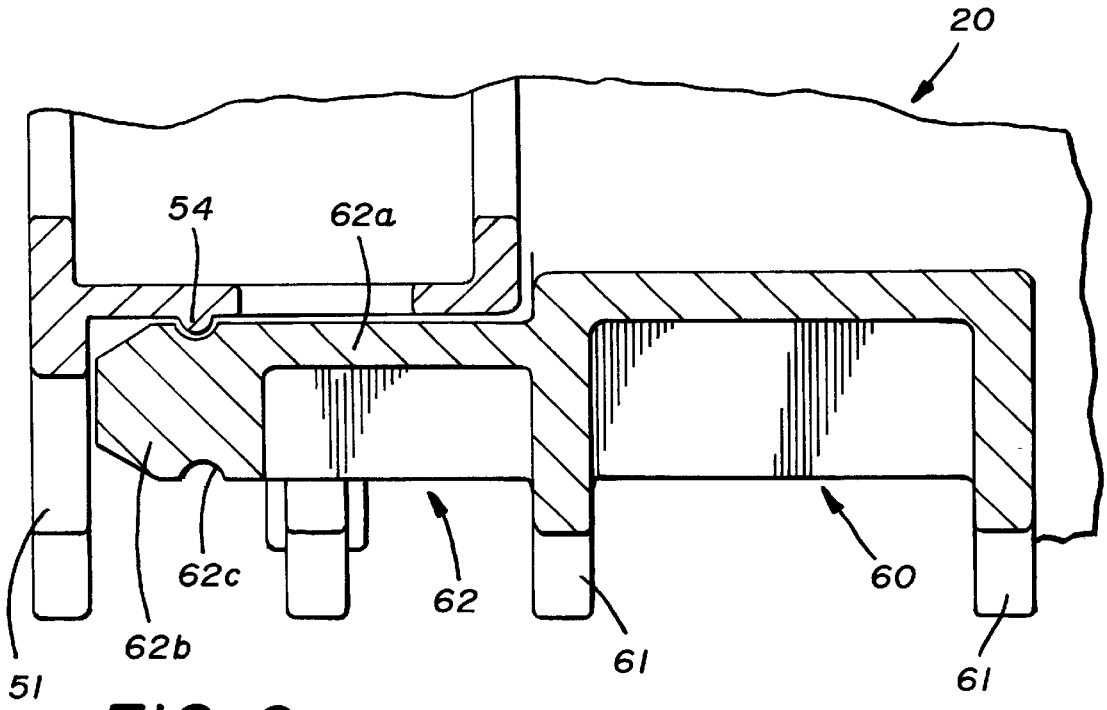
FIG. 6 is a sectional view taken along the line 6—6 of FIG. 4.
Figure 8:
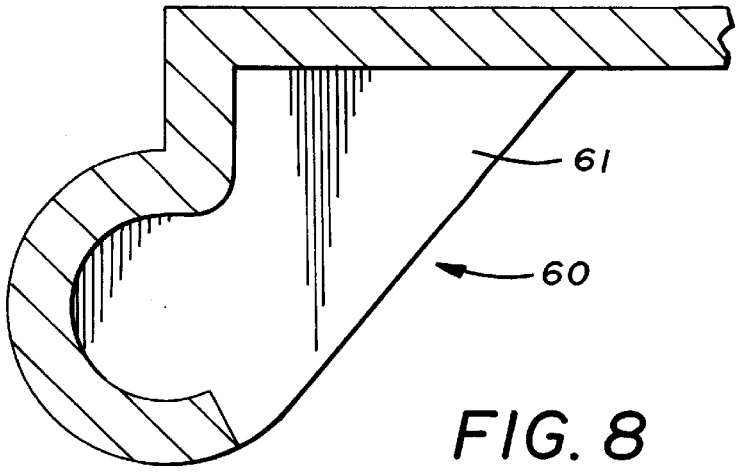
FIG. 8 is a sectional view taken along the line 8—8 of FIG. 5.

Referring to FIGS. 5 and 6 of the drawings, it will be seen that interiorly of each barrel body 52 a radially projecting rib 54 is formed which cooperates with the hinge pin itself as will also be described below.

Still referring to FIGS. 3 through 8 of the drawings, it will be seen that a pair hinge pin assemblies 60, 60 project from the back plate or support plate 20. As is the case with the hinge barrels 50, 50, support brackets 61, 61 are provided to carry the hinge pins which comprise an elongate, generally tubular member 62. This elongate member 62 has a body portion 62*a* and a head portion 62*b* with an annular groove 62*c* disposed adjacent the distal end of each pin 62.

In use or operation of the dispenser, it is first necessary to assemble the cover 30 and attach it to the back plate 20. This is accomplished by simply sliding the hinge pins 62 axially or laterally into the hinge barrels 52. The distal end of each hinge pin can easily be snapped over the raised rib 54 of the barrels and the groove 62*c* will then register on the ribs 54. In this fashion, the hinge connection will resist disassembly during normal operation. It is, however, possible to disassemble the cover from the back plate by pulling, for example, from the left to the right of FIG. 3 of the drawings to snap the grooves 62*b* out of engagement with the ribs 54 and thereby return the overall components to the FIG. 3 position.

However, when assembled, as illustrated, for example, in FIGS. 4 through 8 of the drawings, it will be seen that any weight applied to the cover 30 will be resisted by the length of the hinge pin 62 even when the cover is in the open position. This is in contrast, of course, to the snap together arrangements of the prior art in which a shaft or hinge pin extending transversely of the back plate is employed and the cover is snapped over that structure so that the only force resisting disassembly through abuse of the cover in the open position is the friction fit in the snap-together arrangement.

It will also be noted that these dispensers are generally fabricated from molded plastic or a similar material and that the components of the hinge assembly may be molded integrally with the cover and back plate for economy and to eliminate or reduce the number of separate parts for the overall dispenser.

While a full and complete description of the invention has been set forth in accordance with the dictates of the Patent Statutes, it should be understood that modifications can be resorted to without departing from the spirit hereof or the scope of the appended claims.

What is claimed is:

1. A hinge assembly for use with a dispenser having an elongate backplate and an elongate cover, the cover being secured at one end to one end of the backplate for movement between open and closed relationship therewith, comprising:

a) a pair of hinge barrels carried by one end of the cover;

b) a pair of hinge pins carried by one end of the backplate;

c) said hinge barrels each including a through aperture for slidable receipt of said hinge pins;

d) wherein said hinge barrels are each substantially circular in cross section and include a circular raised rib on their interior surface; and e) wherein said hinge pins include an annular recess for engagement with said circular raised rib on said hinge barrels.

2. A dispenser comprising an elongate back plate adapted to mount on a vertical surface and an elongate cover, said cover having a pair of hinge barrels carried by a lower end of said cover;

said hinge barrels defining a through aperture; and a pair of hinge pins carried on a lower end of said cover, said hinge pins being slidably received within said barrels for attaching said cover to said base;

wherein said hinge barrels are substantially circular in cross-section and have a circular raised rib extending radially inward from an interior surface of said barrel; wherein each said hinge pin has a head portion at a distal end thereof; and each said hinge pin defines an annular recess for engagement with said raised rib on said hinge barrels; and wherein said pins and barrels are oriented generally horizontally whereby weight applied to said cover is resisted by the length of said hinge pins.

* * * * *